166-66 SR
1/26/88 XR 4,721,158

United States Patent [19]
Merritt, Jr. et al.

[11] Patent Number: 4,721,158
[45] Date of Patent: Jan. 26, 1988

[54] FLUID INJECTION CONTROL SYSTEM

[75] Inventors: James A. Merritt, Jr., Levelland; Gary L. Brelsford, Katy, both of Tex.

[73] Assignee: Amoco Corporation, Chicago, Ill.

[21] Appl. No.: 896,997

[22] Filed: Aug. 15, 1986

[51] Int. Cl.[4] ..... E21B 44/00; E21B 47/00; E21B 47/06

[52] U.S. Cl. ..... 166/250; 166/52; 166/53; 166/66; 166/252; 166/305.1

[58] Field of Search ..... 166/250, 252, 268, 52, 166/53, 54, 66, 370, 372, 305.1

[56] References Cited

U.S. PATENT DOCUMENTS

| | | | |
|---|---|---|---|
| 1,740,106 | 12/1929 | Lake | 166/52 |
| 4,374,544 | 2/1983 | Westerman et al. | 166/252 |
| 4,573,115 | 2/1986 | Halgrimson | 364/138 |
| 4,615,390 | 10/1986 | Lucas et al. | 166/250 |
| 4,616,700 | 10/1986 | Wood et al. | 166/250 |
| 4,633,954 | 1/1987 | Dixon et al. | 166/53 X |
| 4,676,313 | 6/1987 | Rinaldi | 166/252 |

FOREIGN PATENT DOCUMENTS

| | | | |
|---|---|---|---|
| 0700641 | 12/1979 | U.S.S.R. | 166/66 |

*Primary Examiner*—George A. Suchfield
*Attorney, Agent, or Firm*—Scott H. Brown; Fred E. Hook

[57] ABSTRACT

Disclosed herein is a method and related system for controlling the injection of fluid into a plurality of spaced wellbores using a fluid distribution system to direct fluid from a fluid source to each of the spaced wellbores. In the method, high/low fluid flow rate limits and high/low fluid pressure limits for each wellbore are determined and inputted into an RTU. The fluid flow rate and fluid pressure for each wellbore are measured at the fluid distribution system and the measured fluid flow rate and the fluid pressure for each wellbore are compared to the determined limits. Thereafter, the flow of fluid to each wellbore is adjusted at the fluid distribution system for those wellbores that have a measured fluid flow rate and/or fluid pressure outside of the determined limits and the adjustment is continued until the measured flow rate and fluid pressure are within the determined limits.

24 Claims, 1 Drawing Figure

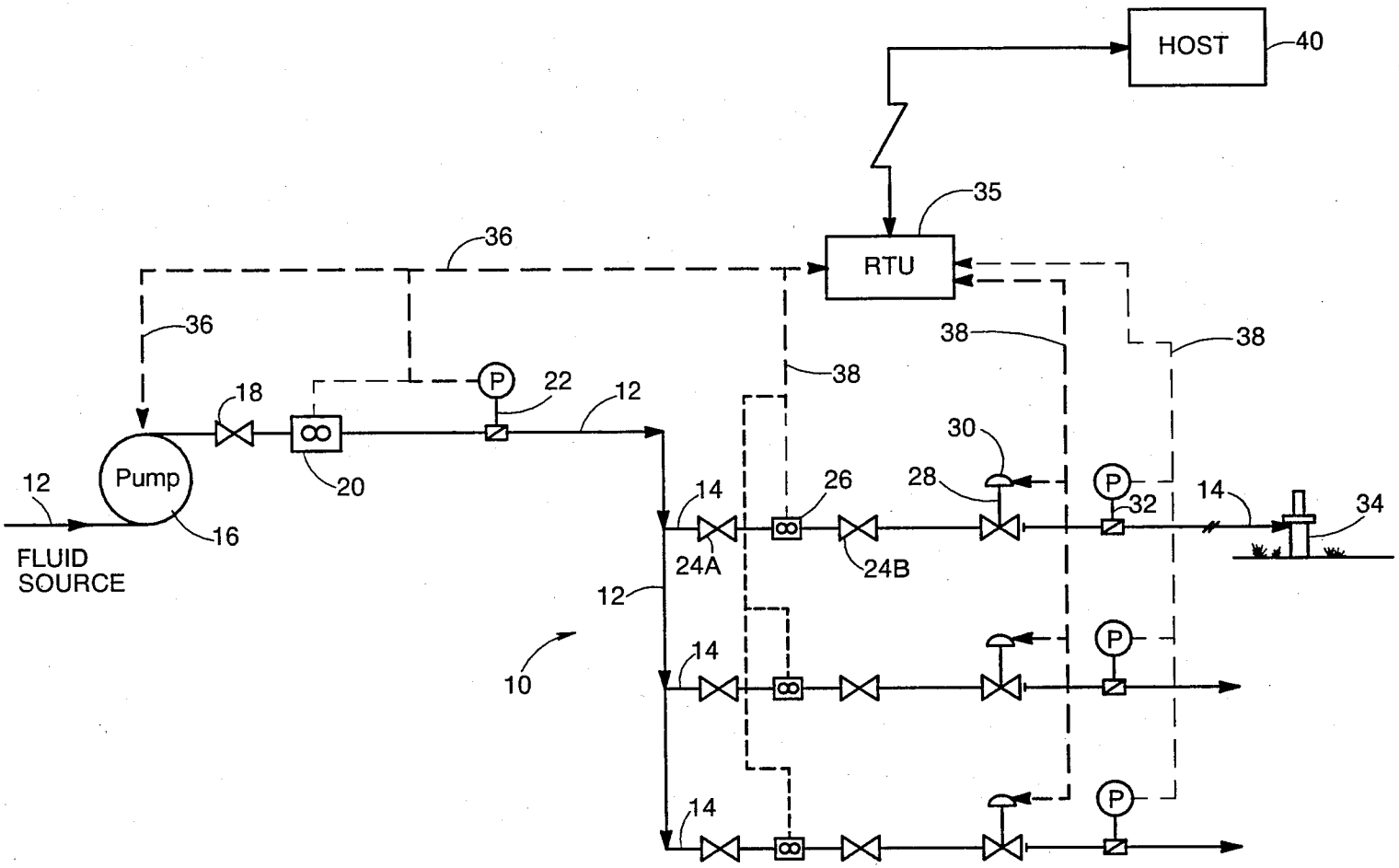
HOST
40
RTU
35
38
38
38
34
14
32
30
28
24B
26
14
24A
14
14
12
12
10
22
36
20
18
36
16
Pump
12
FLUID
SOURCE

FLUID INJECTION CONTROL SYSTEM

BACKGROUND OF THE INVENTION

1. Field of the Invention

The present invention relates to a fluid injection control system and, more particularly, to such a system that is used to control the injection of fluid into a plurality of wellbores.

2. Description of the Prior Art

After a hydrocarbon-bearing subterranean formation has ceased producing fluid under its own pressure, a form of artificial lift is utilized to bring the hydrocarbons to the surface. After artificial lift has been utilized, then it is oftentimes advisable to use some form of fluid injection to drive the hydrocarbons from the injection well(s) to one or more production wells. The drive fluid can include water, inert gases (such as nitrogen and carbon dioxide), and waterflooding chemicals, usually surfactants. The injection of fluid increases the quantity of hydrocarbon production and prolongs the economic life of the field.

In the injection of fluid into a hydrocarbon bearing subterranean formation, there is a need for accurate control of the quantity of fluid injected, as well as the pressure at which the fluid is injected. If too little fluid is injected, then the optimum drive mechanism may not be established and all of the available hydrocarbons cannot be recovered. Also, if the injection pressure exceeds the parting or fracture pressure (commonly referred to as the bottomhole treating pressure) of the formation, cracks can form within the formation to provide channeling from the injection well to the production well so that the fluid passes directly through channels and not out into the formation to sweep or drive the hydrocarbons to the production wells.

Various fluid injection control systems utilizing computers have been described and used in the past to accurately control the injection of fluids into an injection well. Two such systems are described in U.S. Pat. No. 4,374,544 and U.S. patent application Ser. No. 546,614 filed Oct. 28, 1983 now U.S. Pat. No. 4,615,390 .The latter system is also described in the article "Solar Powered Controller Improves Water Injection," World Oil, April 1981. Both of these prior art systems, as well as all fluid injection control systems known to the inventors hereof, are located at each injection wellhead. In these systems, each injection well includes a pressure transducer, a flow measuring device, such as a turbine meter, and a Remote Terminal Unit (RTU) which is in communication via a hardwire or radio link to a controlling computer, commonly referred to as a host computer. As beneficial as the prior art systems are in the control of the injection of fluid, the arrangements described in the prior art systems are not preferable for use with a radial injection system.

A radial injection system, as is well known to those skilled in the art, includes a large volume feed of fluid that passes into a fluid distribution device, called a header, which includes a plurality of controlled outlets. Each outlet is in communication via a conduit to an injection well. The benefits of such a radial injection system is that at a central location the control of the injection of the fluid into each well can be accomplished without the need for the injection control personnel to travel to each wellhead, which may be spaced several miles apart each from the other. By using a radial injection system, the manpower cost, as well as equipment maintenance, is greatly reduced.

The problem with using the prior art systems on a radial injection system is that each wellhead would include an RTU, a turbine meter, a pressure transducer, necessary control valves, and several miles of hardwire cable and/or expensive communication equipment so that each wellhead can communicate to a control facility. There exists a need for a simple, inexpensive, and accurate control system for the injection of fluid into a plurality of wellbores from a single location to eliminate the need for placing the control equipment at each wellhead.

SUMMARY OF THE INVENTION

The present invention has been designed to meet the above described needs and overcome the foregoing deficiencies. Specifically, the present invention is a method and related system for controlling the injection of fluid into a plurality of spaced wellbores using a fluid distribution system to direct fluid from a fluid source to each of the spaced wellbores. The operator of the system of the present invention inputs for each wellbore high/low fluid rate limits and high/low fluid pressure limits. During the system's operation, the fluid flow rate and the fluid pressure for each wellbore is measured, at a predetermined time increment, at the fluid distribution system, not at each wellhead. Thereafter, the measured fluid flow rates and the fluid pressure rates for each wellbore are compared to the determined limits for each wellbore, and if a measured fluid flow rate and/or a fluid pressure rate for a particular wellbore are/is outside of the predetermined limit(s), then the flow of fluid to that wellbore is adjusted, at the fluid distribution system, until the measured flow rate and the fluid pressure are within the determined limits.

By using the method and system of the present invention, the measuring of fluid flow rate and fluid pressure are accomplished at a single location and the adjusting of the flow of fluid to each wellbore is controlled again at the single location. Therefore, a single RTU can be utilized to control the injection of fluid into a plurality of wellbores even though the wellbores are spaced many miles apart, thus reducing equipment costs, maintenance requirements, and cost of extensive hardwire or radial communication links.

BRIEF DESCRIPTION OF THE DRAWING

The drawing is a schematic view of a system, embodying the present invention, for injecting fluid into a plurality of wellbores from a fluid distribution system and including a microprocessor controlled Remote Terminal Unit (RTU).

DETAILED DESCRIPTION OF THE PREFERRED EMBODIMENTS

The present invention provides a method and related system for controlling the injection of fluid into a plurality of spaced wellbores using a fluid distribution system to direct fluid from a fluid source to each of the spaced wellbores. The system of the present invention includes devices for measuring, at the fluid distribution system, the fluid flow rate and the fluid pressure for each wellbore. A comparison device, such as a microprocessor based RTU and related software contained within memory associated therewith, is utilized for comparing the measured flow rate and fluid pressure for each wellbore to high/low fluid flow rate limits and high/low fluid pressure limits inputted thereinto for each wellbore. Also included are devices for adjusting, at the fluid distribution system, the flow of fluid into each wellbore that has a measured flow rate and/or fluid pressure outside of the inputted limits therefor. This adjustment is continued until the measured flow rate and the fluid pressure for that wellbore are within the specified inputted limits for that wellbore. In specific terms, the present invention is a system for attachment to a fluid distribution system and not the fluid distribution system itself.

As shown in the Drawing, the fluid distribution system is indicated by reference numeral 10, and includes an input conduit 12 with a plurality of secondary conduits 14 branching off therefrom. Usually, the input conduit 12 is larger in diameter than the secondary conduits 14. The flow distribution system acts as a manifold or a header to direct fluid through the secondary conduits 14 to a plurality of wellbores. An input end of the input conduit 12 is connected to a source of the fluid. The fluid to be injected can include water, one or more inert gases (such as nitrogen and carbon dioxide), various chemicals, such as surfactants, and mixtures of any of these. The fluid enters the input conduit 12 and passes through a pump 16 that drives the fluid through a manually or remotely operated shutoff valve 18. A fluid flow measuring device 20, such as a turbine meter, and a fluid pressure measuring device 22, such as a pressure transducer, are mounted to the input conduit 12 downstream of the pump 16. After the fluid branches off to each of the desired secondary conduits 14, the fluid will pass through manually or remotely operated isolation valves **24*a* and 24*b*. A fluid flow measuring device 26, such as a turbine meter, and a fluid flow control valve 28 are mounted to each secondary conduit 14. The valve 28 can be of any commercially available type, but is preferably a metering valve. The valve 28 includes mechanical, electric, or fluidic-actuator devices 30 for the remote operation of the valve 28, as is well known to those skilled in the art. The fluid then passes a fluid pressure measuring device 32, such as a fluid pressure transducer, and out through the secondary conduit 14 to an injection wellhead 34** operatively connected to the wellbore.

As shown in the Drawing, the pump 16, the fluid flow measuring device 20, and the fluid pressure measuring device 22, are in communication with a microprocessor based Remote Terminal Unit 35 by a communication link 36, as shown on the dotted lines. The communication link 36 can be hardwire, such as telephone line, coaxial cable or fiber optic cable, or a radial telemetry system, such as FM radial, UHF, or satellite communication link, again as are well known to those skilled in the art.

Also, the fluid flow measuring devices 26, valve control devices 30, and the pressure measuring devices 32 are in communication with the RTU 35 by a communication link 38, which can be the same as or of a different type as the communication link 36. The communication link 36 between the RTU 35 and the pump 16 can be two-way, as well as the communication link 38 between the RTU 35 and the valve control devices 30. The Remote Terminal Unit 35 comprises a microprocessor based device which can be powered by batteries, solar panels, supplied electrical current, or the like, or any combinations of these, as is fully described in U.S. Pat. No. 4,374,544. The Remote Terminal Unit 35 can be in communication via be a hardwire, radio, or satellite link with a remotely located host computer 40. The host computer 40 is used for monitoring purposes, application program alteration purposes, and backup control purposed if needed. The importance of the type of and sizing of the fluid control equipment for the fluid distribution system is set forth in the article "Solar Powered Controller Improves Water Injection" supra.

Now that the system components have been described, the description of the overall system operation will be provided. Upon startup of the fluid injection control system, computer programs within the associated memory of the RTU 35 check the power status to each of the system components at predetermined time increments, such as every 10 seconds. The system operator inputs into the associated memory of the RTU 35 via the host computer 40, or by a terminal, the control limits for each of the wellbores, which in the present invention can be up to about 60 in number. The limits contemplated for use for each wellbore are a high flow rate limit, a low flow rate limit, and a high fluid pressure limit, and a low fluid pressure limit.

After ensuring that the valve 18 is open and that the respective valves **24*a* and 24*b* for each of the secondary conduits 14 to the individual wellheads 34 are open as desired, the pump 16 is activated. Fluid is drawn from its source and can be mixed to contain more than one component as desired, either prior to or after the introduction into the pump. The fluid passes the turbine meter 20 and the pressure transducer 22 and from the signals therefrom the RTU 35 can calculate if the correct quantity of fluid and correct pressure of fluid are present in the input conduit 12. The fluid then passes into each of the open secondary conduits 14, past the turbine meter 26 and the pressure transducer 32 associated therewith. Computer programs within the associated memory of the RTU 35 receive the fluid flow rate signals and fluid pressure signals for each wellhead on a continuous time incremented basis. These signal values are stored for later use, as will be described hereinbelow. The comparison programs stored within the associated memory compares the measured fluid flow rate and the measured fluid pressure to the inputted predetermined limits. If the fluid flow rate and the fluid pressure are within the predetermined limits, then no adjustment is made to the open/close position of the valve 28. However, if the fluid flow rate and/or the fluid pressure for a wellbore are outside of the predetermined inputted limits, then computer programs calculate in what direction, either open or close, the valve control devices 30 should move the valve 28 to control the fluid flow to that wellbore. Once the adjustment has been made to the valve 28, then the cycle of reading and comparing the fluid flow rate and fluid pressure for that wellbore are continued and if further adjustment is needed, that adjustment is made by directing the open or close adjustment to the valve control devices 30**.

Since, in the control of the fluid injection system, two processes are considered and only one control element is used (the valve 28), an override controller is necessary. During normal operation, both fluid flow rate and fluid pressure are limited to be within some predetermined limits. The process signals are processed to be in the same format as the inputted limit so that it is possible to compare the two. The signal from the turbine meters 20, 26 is a frequency which is proportional to flow rate. To use this signal, it is necessary to amplify the low level signal from the turbine meters 20, 26 and to convert the frequency to an analog voltage. The frequency pulses are squared and then the resulting squared signal is integrated. The pressure signal is produced by a strain gauge transducer 22, 32 with the output being a low level signal. Again, it must be amplified to the same level as the limit signal. Since the fluid pressure transducers 22, 32 requires a large amount of excitation power, voltages are applied for a duration of 12 ms, every 500 ms. The resulting output voltage is sampled during the 12 ms period and the value is held until the next sample is made. In this way, the pressure value is updated every 0.5 seconds and the power consumption of the transducer 22, 32 is held to a minimum.

Another method would be to count the number of digital pulses from the turbine meters with a running accumulator. Computer programs associated with the RTU 35 then convert the accumulated pulses to instantaneous flow rate, thereby eliminating the need for conversion and integration of signals.

Any errors between the predetermined inputted control limits and the measured limits are detected by the comparison computer program with the control circuit determining both the magnitude and the sign of the error. The error that is most positive is selected as the control error. That is, the controller automatically determines which process (pressure or flow) is critical and produces a control output that is proportional to the magnitude of the error and in the direction to correct the error. The proportionality of the pulse to control output is achieved by lengthening the control pulse when the error is large and shortening the pulse when the error is small. When the error is less than 1% of the limits, no control output is produced, giving a ±1% control dead band. Another method would be to use a hardwired pulse length per control and a simple look-up logic table where the signal values are compared to the limits; then an action will be logically presented. One such table will be described hereafter.

The following relationships between fluid pressure and fluid flow rate are provided to indicate the action necessary for the control of the valve 28.

| | | | | | |
|---|---|---|---|---|---|
| Pressure | High | *I | II | | III |
| | | IV | V | | VI |
| | Low | VII | VII | | *IX |
| | | LOW | Flow Rate | HIGH | |

| Region | Pressure Condition | Flow Rate Condition | Action of Valve |
|---|---|---|---|
| I | High | Low | Close |
| II | High | OK | Close |
| III | High | High | Close |
| IV | OK | Low | Open |
| V | OK | OK | None |
| VI | OK | High | Close |
| VII | Low | Low | Open |
| VIII | Low | OK | Open |
| IX | Low | High | Close |

If the conditions marked by the * are reached, then one process value is outside of the control limit specified in an injection control file stored within the RTU 35 and the other process value is outside in a different direction, i.e., one value is higher while the other value is lower than its limits. This condition could indicate a physical problem within the wellbore, or that the limits need to be adjusted to a more realistic value.

The frequency at which the control computer program executes is determined by the magnitude of the difference in the actual process values. In this manner, the control program:

calculates the bandwidth (high limit−low limit)÷2=bandwidth, calculates the deviation limit vs actual (limit−actual)=deviation, calculates the number of bandwidth deviations (deviation/bandwith)=number of bandwidth difference, calculates the new frequency counter if the number of the bandwidth difference is greater than the frequency limit and the new frequency counter is equal to 1, else the new frequency counter equals the frequency limit minus the number of bandwidths difference, adjusts the actual frequency counter using the frequency constant stored within the control program, and if the new frequency counter is less than the frequency constant, then the actual frequency counter equals the frequency constant, else the actual frequency counter is equal the new frequency counter.

The frequency counter is decremented each time the program runs through its sequence and the control program runs when the counter is zero and a new frequency is calculated each time the program runs to completion.

Associated with the RTU 35 are other computer programs to allow for statistical data to be recorded, transmitted, or displayed in visual screen (CRT) or hardcopy form at the RTU 35 and/or the host 40. Such statistical data can include the fluid flow pressure over a sampled time period, such as every 24 hours, for each wellhead, fluid flow rate to each well, as well as the fluid flow pressure and fluid flow rate through the main fluid conduit 12. Also, the statistical data usually include the total volume or fluid passing over a given time period to each wellbore and accumulates that and compares that to the fluid flow calculated passing through the turbine meter 20 and the fluid pressure transducer 22. If the quantity of fluid passed through the conduit 12 does not equal to the combined total fluid passing through all the secondary flow conduits 14, then a leak exists within the fluid distribution system and an alert signal will be actuated for the operator. Also, the valves **24*a* and 18** can be automatically closed, if included with remote control operation devices to isolate the leak if needed.

Further, the RTU 35 includes computer programs to allow the printing, filing and recording of data to the operator at the location of the fluid distribution system, where the RTU 35 is located or to transmit this information to the host computer 40, where the status of the fluid distribution system can be monitored, as well as the control limits and the amount of water injected can be monitored, but the control limits can be altered if desired.

Wherein the present invention has been described in particular relation to the drawings attached hereto, it should be understood that other and further modifications, apart from those shown or suggested herein, may be made within the sphere and scope of the present invention.

What is claimed is:

1. A method of controlling the injection of fluid into a plurality of spaced wellbores using a single remote terminal unit located at a fluid distribution system to direct fluid from a fluid source to each of the spaced wellbores, comprising:

(a) determining for each wellbore high/low fluid flow rate limits and high/low fluid pressure limits;

(b) utilizing the remote terminal unit, measuring, at the fluid distribution system, the fluid flow rate and the fluid pressure for each wellbore;

(d) utilizing the remote terminal unit, comparing the measured fluid flow rate and the fluid pressure for each wellbore to the determined limits; and (d) adjusting, at the fluid distribution system, the flow of fluid to each wellbore that has a measured fluid flow rate and/or fluid pressure outside of the determined limits unitl the measured flow rate and the fluid pressure are within the determined limits.

2. The method of claim 1 wherein the fluid is selected from the group consisting of water, at least one gas, at least one chemical, and mixtures thereof.

3. The method of claim 1 wherein the fluid distribution system comprises a header, including an inlet for fluid, a plurality of fluid outlets each in communication through a conduit with a wellbore, and a fluid flow control device on each conduit.

4. The method of claim 1 wherein the fluid distribution system is spaced from the wellbores.

5. The method of claim 1 wherein steps (b), (c), and (d) are sequentially executed on a timed basis.

6. The method of claim 1 wherein step (d) comprises adjusting the position of a valve associated with the fluid distribution system for each wellbore having a measured flow and/or fluid pressure outside of the determined limits of step (a).

7. The method of claim 1 and including determining if a fluid leak in the fluid distribution system exists, and if so, ceasing the flow of fluid through that portion of the fluid distribution system associated with the fluid leak.

8. The method of claim 7 and including measuring the fluid flow rate and pressure of the fluid prior to introduction into the fluid distribution system.

9. The method of claim 1 and including accumulating the volume of fluid injected into each wellbore.

10. The method of claim 1 and including storing the fluid flow rate and the fluid pressure for each wellbore over a given time period.

11. A system for controlling the injection of fluid into a plurality of spaced wellbores using a single remote terminal unit located at a fluid distribution system to direct fluid from a fluid source to each of the spaced wellbores, comprising:

means for measuring, at the fluid distribution system, the fluid flow rate and the fluid pressure for each wellbore;

the remote terminal unit comprising comparison means for comparing the measured flow rate and fluid pressure for each wellbore to high/low fluid flow rate limits and high/low fluid pressure limits inputted thereinto; and means for adjusting, at the fluid distribution system, the flow of fluid to each wellbore that has a measured fluid flow rate and/or fluid pressure outside of the inputted limits therefore, to bring the measured flow rate and the fluid pressure within the inputted limits.

12. The system of claim 11 wherein the fluid is selected from the group consisting of water, at least one gas, at least one chemical, and mixtures thereof.

13. The system of claim 11 wherein the fluid distribution system comprises a radial fluid injection system.

14. The system of 13 wherein the radial fluid injection system comprises a header, including an inlet for fluid, a plurality of fluid outlets each in communication though a conduit with a wellbore, and a fluid control device on each conduit.

15. The system of claim 11 wherein the fluid distribution system is spaced from the wellbores.

16. The system of claim 11 wherein the means for measuring comprises a fluid flow meter and a fluid pressure sensor, both providing signals therefrom to the comparison means.

17. The system of claim 11 wherein the comparison means comprises a programmable digital computer having memory devices associated therewith.

18. The system of claim 11 wherein the means of adjusting comprises valves for each wellbore associated with the fluid distribution system.

19. The system of claim 18 and including means for remotely operating each valve.

20. The system of claim 11 and including means for determining if a fluid leak in the fluid distribution system exists.

21. The system of claim 20 wherein the means for determining comprises a flow rate measurement device and a flow pressure measurement device on an upstream portion of the fluid distribution system, means for measuring the fluid flow rate and fluid pressure on a downstream portion of the fluid distribution system, and means for comparing the fluid flow rate and fluid pressure signals upstream to the downstream signals.

22. The system of claim 20 wherein the means for determining comprises means for determining the volume of fluid passing into the fluid distribution system, means for determining total volume of the fluid injected into the wellbores, and means for comparing the volume of fluid inputted into the fluid distribution system to the total volume of fluid injected into the wellbores.

23. The system of claim 11 and including means to input the high/low fluid flow limits of high/low fluid pressure limits to the comparison means from a remote location.

24. The system of claim 11 and including means to control the means for adjusting from a remote location.

* * * * *